United States Patent [19]

Baldo

[11] Patent Number: 5,044,126

[45] Date of Patent: Sep. 3, 1991

[54] TANGENTIAL GRINDING MACHINE

[75] Inventor: Claudio Baldo, Mestre Venezia, Italy

[73] Assignee: Rotrafer S.p.A., Padua, Italy

[21] Appl. No.: 335,670

[22] PCT Filed: Sep. 30, 1987

[86] PCT No.: PCT/EP87/00560

§ 371 Date: May 11, 1989

§ 102(e) Date: May 11, 1989

[87] PCT Pub. No.: WO88/02300

PCT Pub. Date: Apr. 7, 1988

[30] Foreign Application Priority Data

Oct. 1, 1986 [IT] Italy ..... 84140 A/86

[51] Int. Cl.[5] ..... E01B 31/17

[52] U.S. Cl. ..... 51/178; 51/165.87; 51/347; 51/5 D; 51/262 T

[58] Field of Search ..... 51/178, 241 LG, 165.71, 51/165.87, 347, 331, 5 D, 262 T, 351

[56] References Cited

U.S. PATENT DOCUMENTS

| | | | |
|---|---|---|---|
| 1,511,165 | 10/1924 | Jaeger | 51/351 |
| 2,114,454 | 4/1938 | Perazzoli | 51/178 |
| 2,148,766 | 2/1939 | Mall | 51/178 |
| 2,746,217 | 5/1956 | Breisch | 51/351 |
| 2,767,523 | 10/1956 | Vasbinder | 51/331 |
| 4,050,196 | 9/1977 | Theurer | 51/5 D |

*Primary Examiner*—Roscoe V. Parker

*Attorney, Agent, or Firm*—Hoffman, Wasson & Gitler

[57] ABSTRACT

A tangential grinding machine characterized by being provided with at least one grinding device (7) comprising: a rotary member (20), a plurality of abrasive sectors (40) mounted on supports (27) radially mobile on said rotary member (20), and members (23) for radially shifting said supports (27) in order to cause said abrasive sectors (40) to move outwards by an amount suitable for compensating their wear.

26 Claims, 7 Drawing Sheets

TANGENTIAL GRINDING MACHINE

This invention relates to a tangential grinding machines.

Tangential grinding machine are known comprising a grinding device consisting essentially of a grinding wheel of abrasive material which when rotated removes by abrasion a part of the material with which it comes into contact.

Currently known grinding machines comprise either a fixed structure and means for feeding the workpiece towards the abrasive grinding wheel, or an abrasive grinding wheel support structure mobile along the workpiece which is fixed. The particular application and the specific requirements of the workpiece determine the use of one or other type of machine. If for example a rolled section leaving a rolling mill is to be ground, the machine will obviously be of the fixed type, whereas if for example an already laid railway rail is to be ground, the machine will obviously be of the mobile type.

However, independently of the type of structure used, the known grinding devices, ie the assembly consisting of the abrasive tool or tools, its or their rotary drives, adjustment and replacement systems and all other accessory members required for correct operation, they currently suffer a series of limitations and drawbacks which the present invention proposes to obviate.

One of these drawbacks is that each grinding wheel generally consists of a disc of abrasive material and is intended to grind with its circumferential surface at a peripheral speed within a precise and narrow range of values. As the grinding wheel wears with time, and thus its grinding circumference decreases, it is necessary on the one hand to increase its angular speed and on the other hand to shift its axis of rotation with respect to the workpiece, so as to always ensure mutual contact. In all cases, complicated adjustment and control equipment are required, but this does not obviate the need to replace the grinding wheel very frequently, ie while the amount of abrasive material still unused is considerable.

In addition to all the aforesaid drawbacks, which relate to the grinding device of any tangential grinding machine, there are also particular drawbacks encountered in grinding machines used specifically for rail profile restoration in railways, tramways and/or underground railways.

One of these drawbacks is that known rail grinding machines generally use cup grinding wheels, which operate along a narrow longitudinal strip of the rails to be ground. A large number of grinding wheels are therefore required, and as these are mounted on trolleys a large number of these latter are necessary for grinding the adjacent strips which together make up the entire rail profile. The result is an overall space requirement which is often unacceptable, and an imperfect grinding result because of the inevitable rail faceting which appears on termination of the work. In addition, those cup grinding wheels which grind the rail lateral surfaces are impeded by the presence of natural obstacles such as points, guide and retaining plates at the points and, in the particular case of tramlines, the cement and asphaft and also the actual counterweb of the rail itself.

A further drawback of known grinding machines with cup grinding wheels is that said grinding wheels, which both grind the rails and create the reference plane at one and the same time, are consumable elements and as such they change with time and are unsuitable for forming a proper reference plane. This drawback, which in the case of short longitudinal rail undulations (up to 30 cm) can be overcome by the actual dimensions of the cup grinding wheels themselves (which can have a diameter of up to 30 cm), becomes more apparent in lengthy longidudinal undulations, which cannot be covered by the cup grinding wheel dimensions.

A further drawback of known rail grinding machines is that the cup grinding wheels must generally operate simultaneously on both rails for mass balancing reasons. This makes it more difficult to grind a single rail such as the central earth rail or outer side feed rail of underground railways. In addition when these grinding machines operate simultaneously on both rails, the abrasion effect is substantially identical in both. Although this is no problem along straight lengths in which the rail deformation is substantially equal in both, it becomes a problem when grinding curved lengths, in which the inner rail is more loaded and thus more deformed. In such a case, the uniform grinding action on both rails means that more material is ground away from the outer rail (less deformed) than is strictly necessary for its correct restoration.

A further drawback of known grinding machines is that as the individual grinding wheels operate on different surface lying at various angles, they cause sparks to shoot practically in all directions, without it being possible to control or contain them.

U.S. Pat. No. 2,727,341 discloses a tangential grinding machine provided with one grinding machine comprising a rotary member, a plurality of abrasive sectors mounted on supports radially mobile on said rotary member, and members for radially shifting the supports in order to cause the abrasive sectors to move outwards by an amount suitable for compensating their wear.

A drawback of this machine consists in that it does not allow the automatic adjustment of the position of the abrasive sectors according to their wear, in order to substantially keep constant the diameter of the grinding surface.

All these drawbacks are obviated according to the invention by a tangential grinding machines comprising a rotary member, a plurality of abrasive sectors mounted on supports radially mobile on said rotary member, and members for radially shifting said supports in order to cause said abrasive sectors to move outwards by an amount suitable for compensating their wear characterised by comprising a plurality of sensors which are activated when a predetermined degree of wear of the abrasive sectors is reached and which act on the radially shifting members and further comprising an electronic apparatus which processes the signals originating from the sensors and controls members for radially shifting the supports for the abrasive sectors.

A preferred embodiment of the present invention is described in detail hereinafter with reference to the accompanying drawings, in which.

Figure 1:
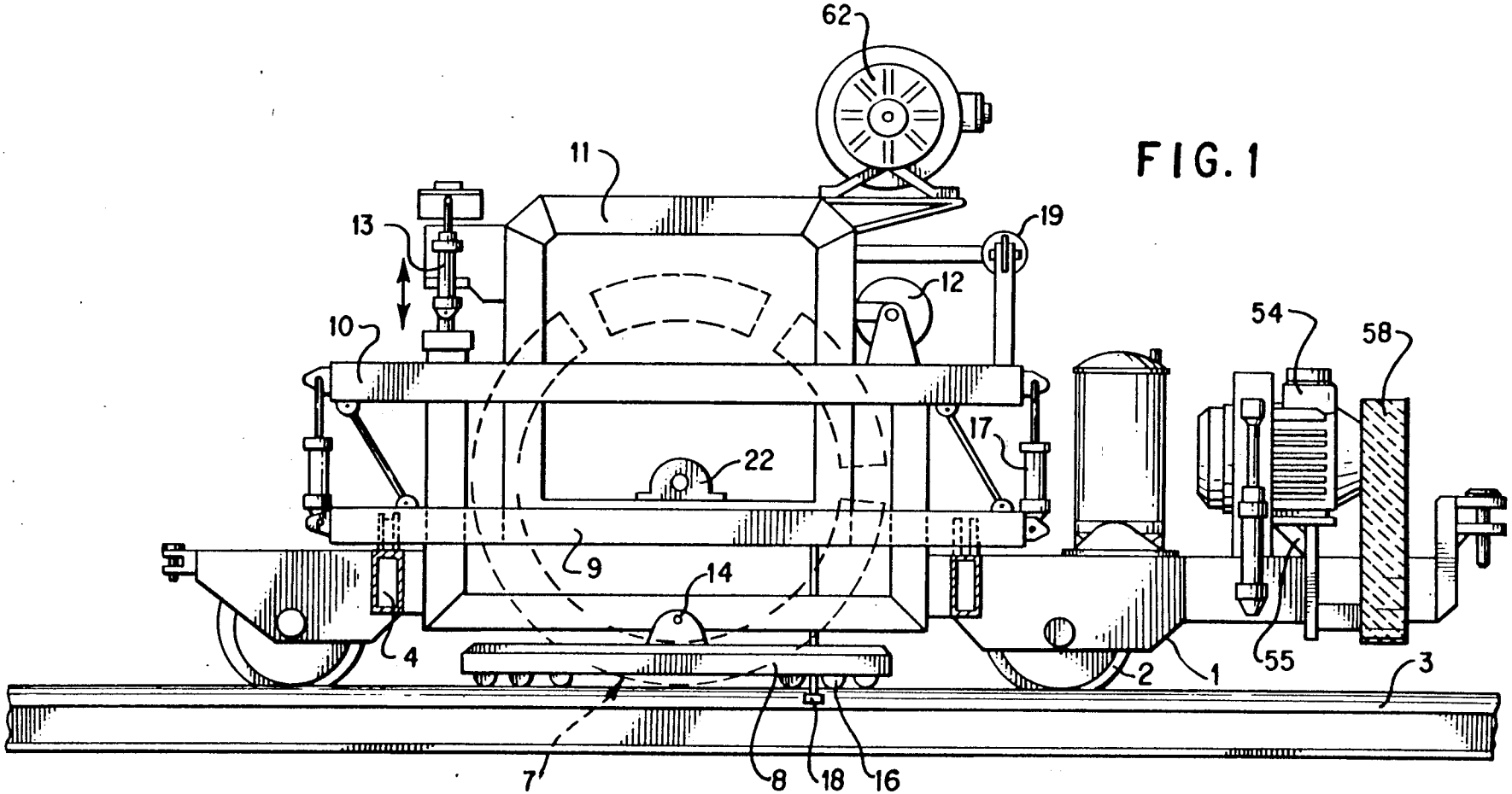
FIG. 1 is a diagrammatic side view of a machine according to the invention.
Figure 2:
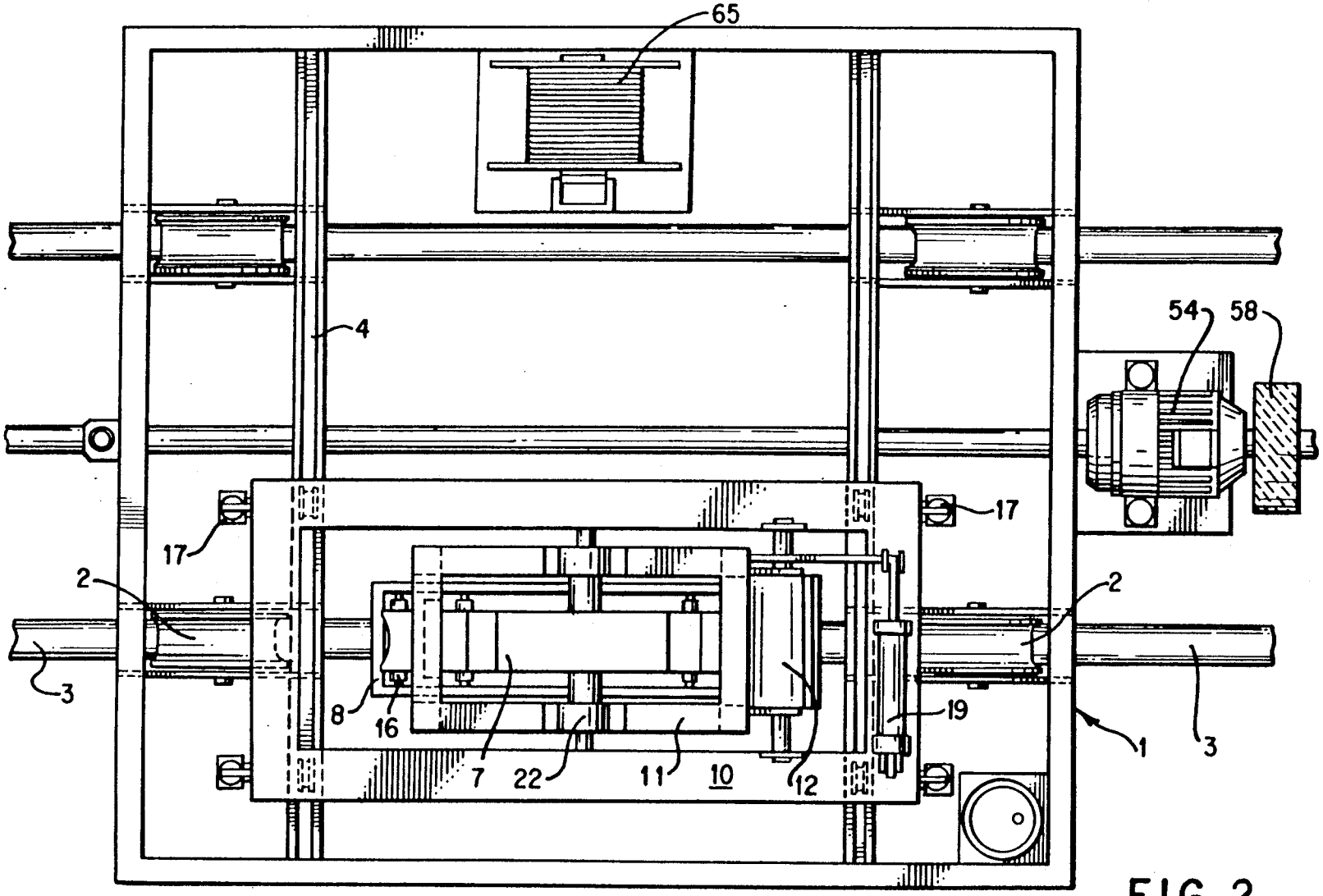
FIG. 2 is a plan view thereof.
Figure 3:
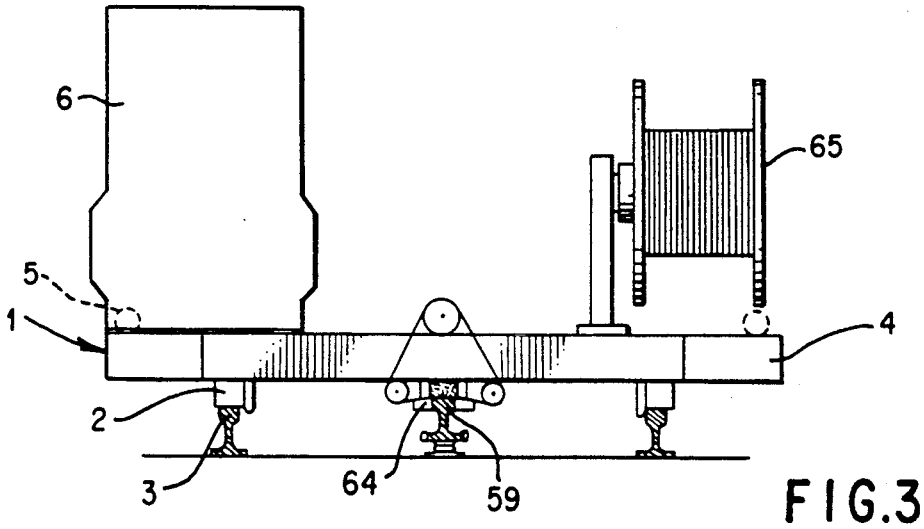
FIG. 3 is a front view thereof.

As can be seen from the figures, the grinding machine according to the invention comprises a framework 1 mounted on wheels 2 which run on rails 3. On the framework 1 there are mounted two transverse guide beams 4 for wheels 5 provided in a mobile structure 6. The mobile structure 6 comprises a grinding device indicated overall by 7 and described in detail hereinafter, and a supporting roller assembly 8.

More specifically, the mobile structure 6 comprises a lower frame 9 which, when the transverse position of the structure 6 along the beams 4 has been chosen, can be locked in that position by any conventional system, and an upper frame 10 connected to the lower frame 9 by a parallelogram system of articulated levers.

The upper frame 10 supports a saddle 11 which is hinged at one end to the frame by a shaft 12 which allows slight axial play, and is hinged at its other end to the same frame by a reduction member 13 which enables it to be adjusted vertically. The connection between the reduction member 13 and upper frame 10 is of articulated type, and as in the case of the shaft 12 allows a limited axial play in order, as will be seen hereinafter, to ensure correct lateral adaptation of the grinding device 7 to the rail to be ground even when inevitable gauge variations exist. The saddle 11 supports the grinding device 7, while the frame 10, which supports the saddle 11, rests on the roller assembly 8 in correspondence with a hinging shaft 14.

The roller assembly 8 comprises a pair of longitudinal bars 15, between which a plurality of idle rollers 16 are positioned. The length of the bars 15 and thus of the roller assembly 8 depends on the particular working requirements. Thus in the case of rails for railway trains, which require considerable rail planarity as they operate at high speed, the roller assembly 8 is made longer even though this results in a larger quantity of material removed during grinding, whereas in the case of rails for trams and underground trains, which can accept slight longitudinal undulation as they operate at a much lower speed, the roller assembly 8 can be shorter and thus limit the quantity of material removed during grinding.

The roller 16 is positioned in the two end portions of the roller assembly 8, so as to leave a central free region for passage of the rotary member of the grinding device 7, as described hereinafter.

The upper frame 10 is moved relative to the lower frame 9 of the mobile structure 6 by hydraulic or pneumatic cylinder-piston units 17 interposed between the two.

The saddle 11 is also provided with a plurality of guide rollers 18 which extend laterally beyond the rollers 16 and adhere to one of the two sides of the rail to be ground. They are urged against this latter by a pneumatic cylinder-piston unit 19 interposed between the saddle 11 and framework 1.

The grinding device 7 mounted on the saddle 11 comprises a cylindrical steel casing 20 with a removable front cover 20'. It is fixed on a shaft 21 supported at its ends by a pair of ball bearings 22 fixed to the saddle 11, and is rotated by an electric motor 62.

Within the casing 20 there is provided an external ring gear 23 mounted on the shaft 21 but free to rotate about it. In that front surface facing the rear wall 24 of the casing 20, the ring gear 23 is provided with a spiral groove 25 of constant pitch in which there engage teeth 26 provided in six slides 27 disposed 60 apart and slidable along radial slots 27' formed in said rear wall 24.

Each slide 27 is retained in the respective guide slot 27' by a pair of metal fillets 28 applied externally to the rear wall 24 and engaged in longitudinal grooves 29 formed laterally in each slide 27.

A clamp 30 carrying the abrasive material is applied to the outer end of each slide 27. Specifically, a plate 33 forming the support for the clamp 30 is fixed to each slide 27 by a pair of keys 31 and screws 32. This plate, which has the approximate shape of a circular sector, comprises, near its curved edge two outer bores and an outwardly open central recess 34. The two outer bores house two corresponding articulation pins 35 for bar 36 to which the clamp 30 is articulated which remains centered with respect to the plate 33 due to the presence of suitable spacers 37. Two threaded pins 38 are housed in and pass through the central recess 34 and are engaged by nuts 39 to tighten the two jaws of the clamp 30 against an abrasive sector 40.

The bore by which the connecting bars 36 are pivotally mounted on the pin 35 is of slotted type to allow the entire clamp 30 to undergo inward radial movements, as will be apparent hereinafter.

The inner perimetral zone of the casing 20 houses three gear wheels 41 disposed 120° apart and engaged with the ring gear 23. The shaft 42 of each gear wheel 41 is supported on the two facing walls of the casing 20 by bushes 43,43', and extends beyond the cover 20' in the form of a portion which is coupled by means of free-wheel device 44 to the end of an operating lever 45, the other end of which is connected to a pneumatic piston 46. This is fed by an external compressor 63, by way of a rotary connector 47 and a duct 48 formed within the shaft 21.

Three supports 49 for three contact sensors 50 are fitted 120° apart on the outer cylindrical surface of the casing 20 in the interspaces between adjacent abrasive sectors 40 and operate in three different planes orthogonal to the axis of the shaft 21. The sensors 50 are connected, through ducts formed within the shaft 21, to a slip-ring assembly 51 for externally transferring the signals. An electronic circuit board receives the signals collected by the slip-ring assembly 51 and controls a solenoid valve (not shown on the drawings) which regulates the compressed air feed into the duct 48.

The grinding device 7 also comprises a profiling roller 53 applied to the saddle 11 and facing the abrasive elements 40 in a position diametrically opposite the zone of contact with the rail 59 to be ground.

In addition to the grinding device 7, the constructional details of which have been described heretofore, there is also mounted in the grinding machine framework 1 a finishing unit indicated overall by 54. It comprises its own structure 55 in which a drive roller 56 is mounted together with a plurality of idle rollers 57; and about which an abrasive band 58 extends disposed in a plane orthogonal to the longitudinal axis of the rail 59 to be ground. A plate 60 shaped to correspond to the upper profile of the rail 59 is kept forcibly adhering to this latter by a pneumatic system 61. Preferably, the position of the finishing unit 54 is adjustable transversely relative to the framework 1, so as to be able to operate on the chosen rail, and in this case guide rails 64 are associated with the plate 60 to adhere to the lateral surfaces of the rail 59 to be ground, and thus ensure centering of the plate with respect to the upper profile thereof.

Finally, the grinding machine according to the invention comprises other accessories such as the operator's driving position, a variable speed motor for advancing the machine during the grinding work, an operating and control panel for the various operating stages, and anything else which could be considered useful in practice for implementing the work under the most effective operating conditions.

In the description of operation of the grinding machine according to the invention given hereinafter, the method of operating the overall machine is kept separate for reasons of clarity from the method of operating the grinding device, which represents its basic element.

In operating the machine, it must firstly be transferred to the position in which the rail 59 to be ground is located. This transfer is preferably done with a locomotive, which can also be provided with a generating unit for self-contained electrical powering of the grinding machine, especially if the track to be ground is not electrified or if the electricity supply has been temporarily suspended during the maintenance work. It is also possible to provide a generator unit mounted on the framework 1 itself, although it is preferable to use electricity fed either through a supply cable from a fixed socket, or a generator unit mounted on an auxiliary truck and, especially during tunnel work, kept a reasonable distance from the machine according to the invention essentially for contamination reasons. In any event, it is advisable to provide a cable winder 65 within the framework 1.

When the grinding machine has been transferred to its working position, it must be set up for correct operation. To do this, a profiling roller 53 corresponding to the shape of the rail 59 to be ground must firstly be mounted, and the mobile structure 6 must be correctly positioned along the beams 4. Then, in relation to the type and extent of deformation of the rail to be ground, the plane in which the roller assembly 8 rests on the rail itself is defined. In this respect, as the upper surface of this rail is generally different from the level at which th machine slides on its own guide rails, it is necessary to lower the frame 10, which during transfer had been kept raised, towards the rail 59 to be ground, until the roller assembly 8 rests on it.

The subsequent adjustment relates to the degree of interference of the grinding device 7 with the resting plane of the roller assembly 8. The extent to which the various rotating abrasive sectors 40 project, and thus the extent of removal of ferrous material, depends on the degree of deformation of the rails and on the set degree of interference. In all cases, the interference is adjusted by operating the reduction unit 13.

The three sensors 50 are then positioned so as to operate on the ideal grinding circumference, ie in the external position reached under centrifugal action by the clamps 30 connected to the respective supports 33.

Finally, the saddle 11 is slightly rotated about longitudinal axis to slightly incline the axis of the grinding device 7 to the plane on which the framework 1 rests on the rails 2, in order to adapt the plane of rotation of the grinding device to the longitudinal plane of the rail to be ground, this plane being slightly inclined in known manner. At this point the machine is ready to operate. The variable speed motore is powered to advance the machine along the rails, and at the same time power is also supplied to the motor which rotates the grinding device 7 and, if required, to the motor coupled to the driving roller 56 of the finishing unit 54, which had been previously positioned to correspond to the rail 59 to be ground. This rail can obviously be either one of the two rails forming the track or the central earth rail or lateral electricity supply rail.

When the shaft 21 is rotated, it rotates the casing 20 and thus the slides 27, the supports 33, the clamps 30 and the abrasive sectors 40, which become disposed in their outer radial position by centrifugal force. As the disc 20 rotates, the grinding machine advances and the rail 59 is ground to correspond to the transverse profile of the abrasive sectors 40. However, as this abrasive action results not only in the removal of part of the constituent material of the rail 59 but also wear of the abrasive sectors 40, after a certain time the sensors 50, which at the commencement had been set with their end on the original grinding surface of the abrasive sectors 40, now project beyond this surface and come into contact with the rail 59 to be ground. A signal generated by this contact is received by the electronic circuit 52 which controls the pulsed feed of compressed air through the connector 48, to thus operate the three pistons 46.

Each piston 46 in its turn operates the relative lever 45, which induces a small rotation of the corresponding gearwheel 41. This rotation, which is common to the three gearwheels, results in a corresponding rotation of the ring gear 23, which because of the engagement between its spiral groove 25 and the slides 27, causes these latter to move slightly outwards simultaneously in order to restore the original abrasion surface which, by removing the material from the rail to be ground, prevents operation of the sensors 50.

Basically, the device according to the invention enables grinding of the rail to be carried out while maintaining a substantially costant diameter of the active abrasion surface.

However the aforegoing, while being rigorously correct from the theoretical viewpoint, has certain practical limits.

Figure 4:
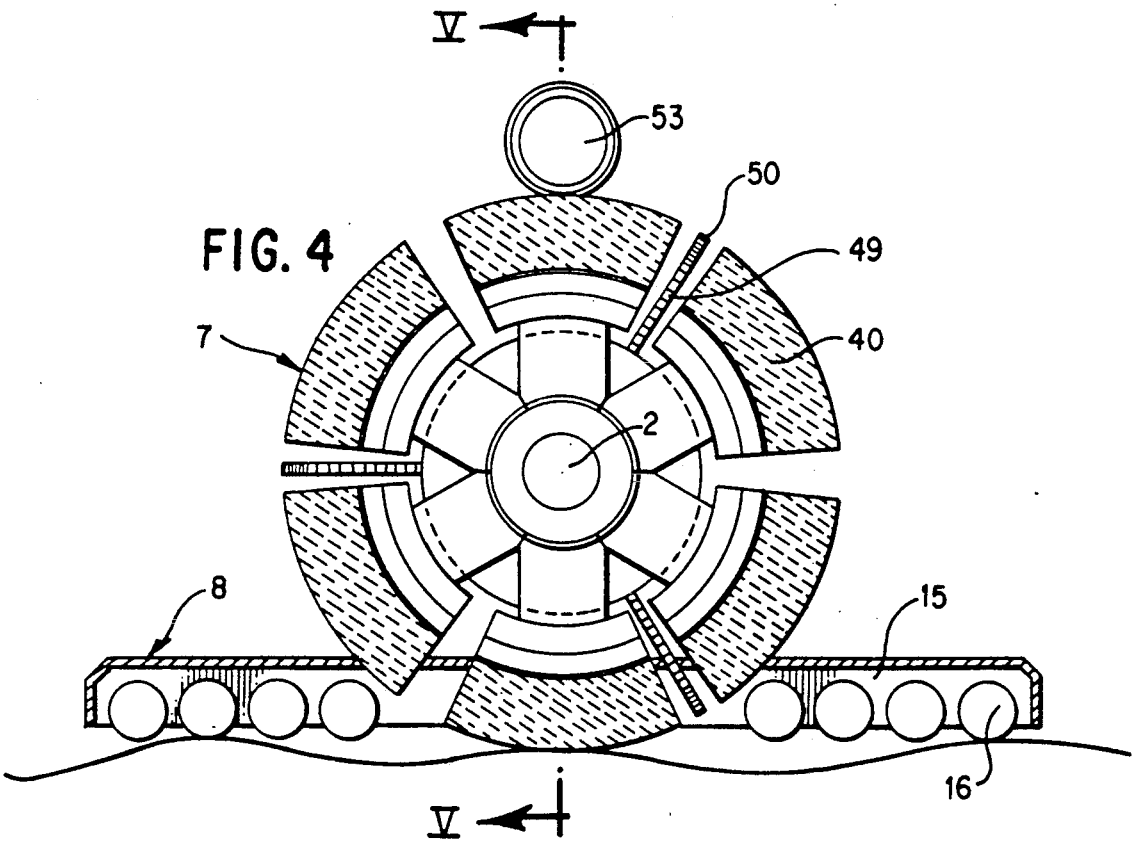
FIG. 4 is an enlarged detailed view of the grinding device and underlying roller assembly, taken in the same direction as FIG. 1.
Figures 5, 5A:
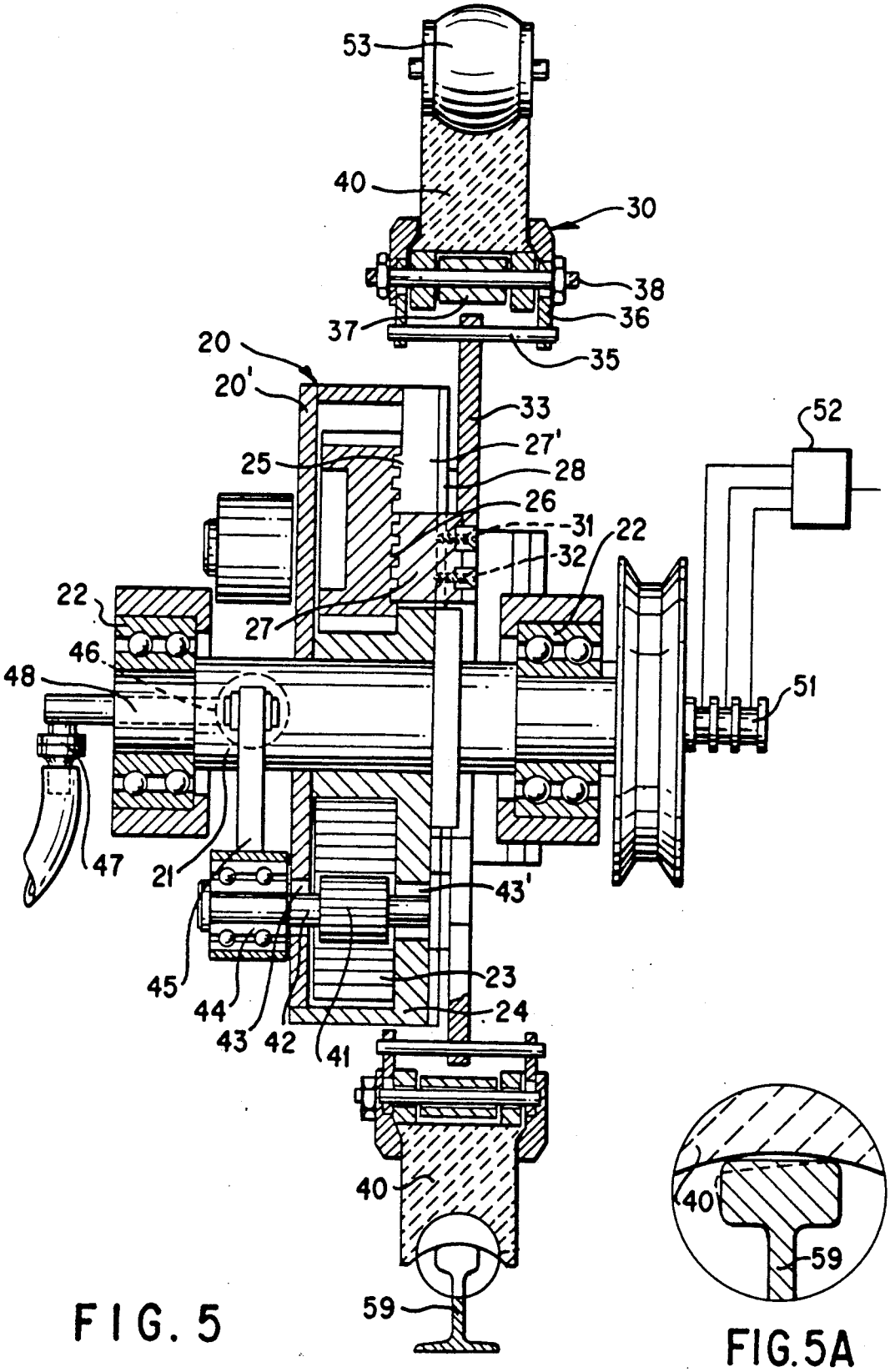
FIG. 5 is a vertical sectional view thereof taken on the line V—V of FIG. 4.
Figure 6:
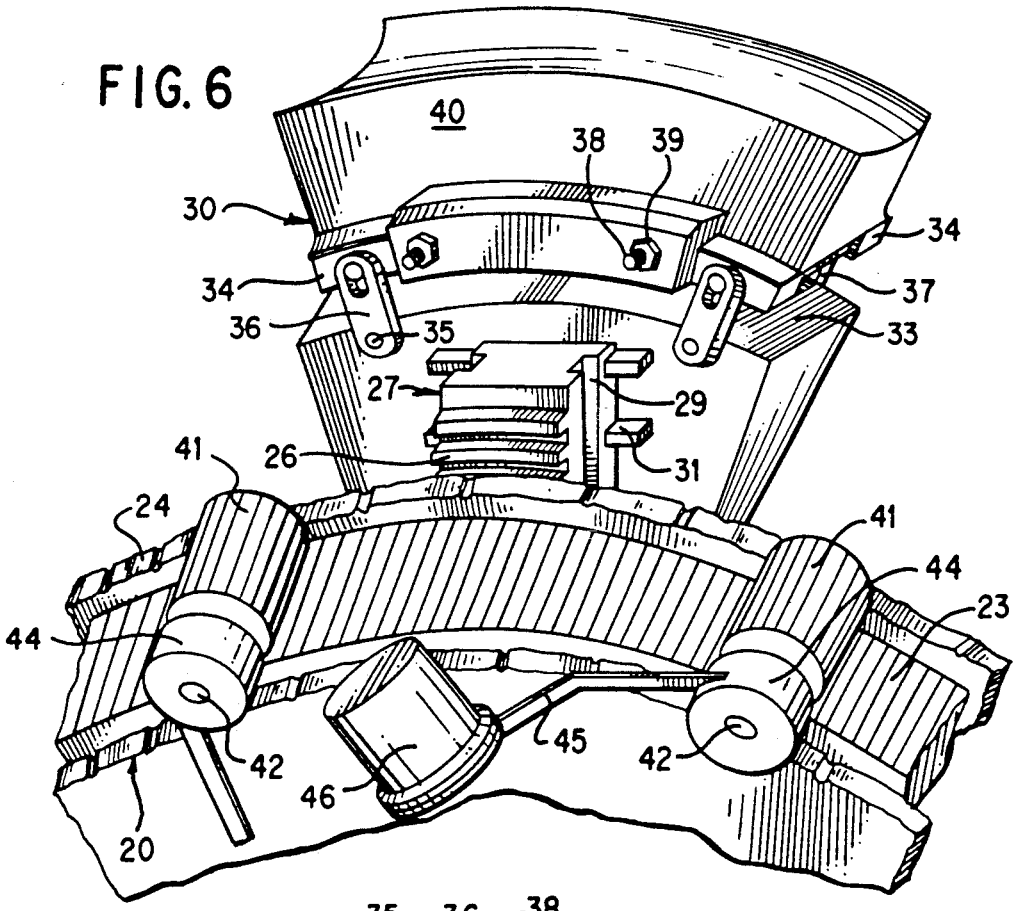
FIG. 6 is a partly perspective and partly sectional view thereof.
Figure 7:
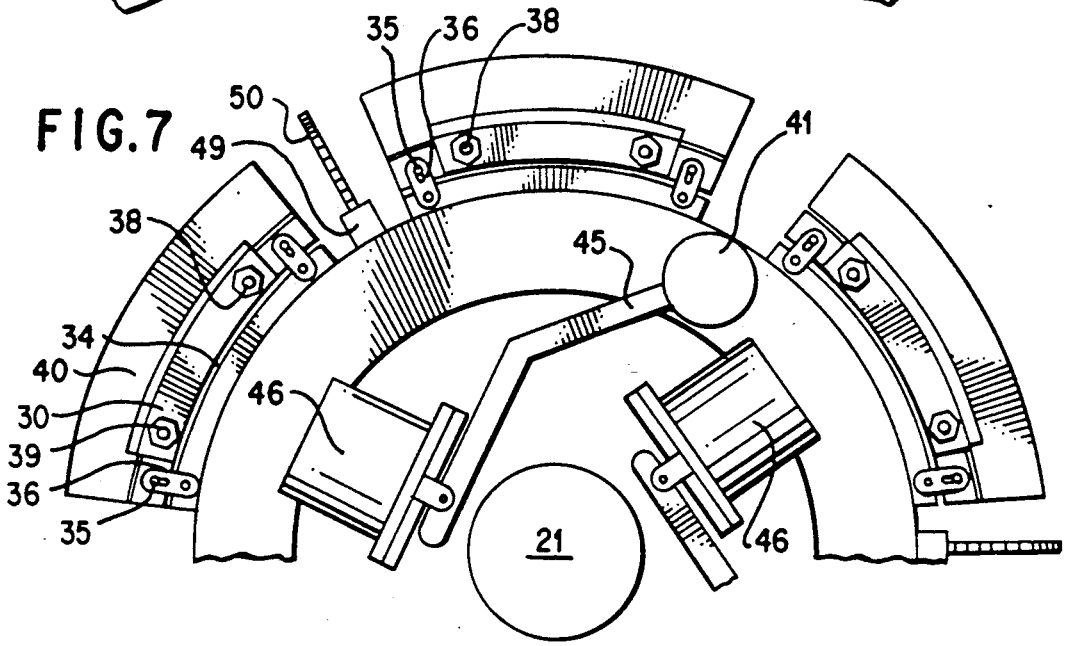
FIG. 7 is an enlarged partial side view thereof.
Figure 8:
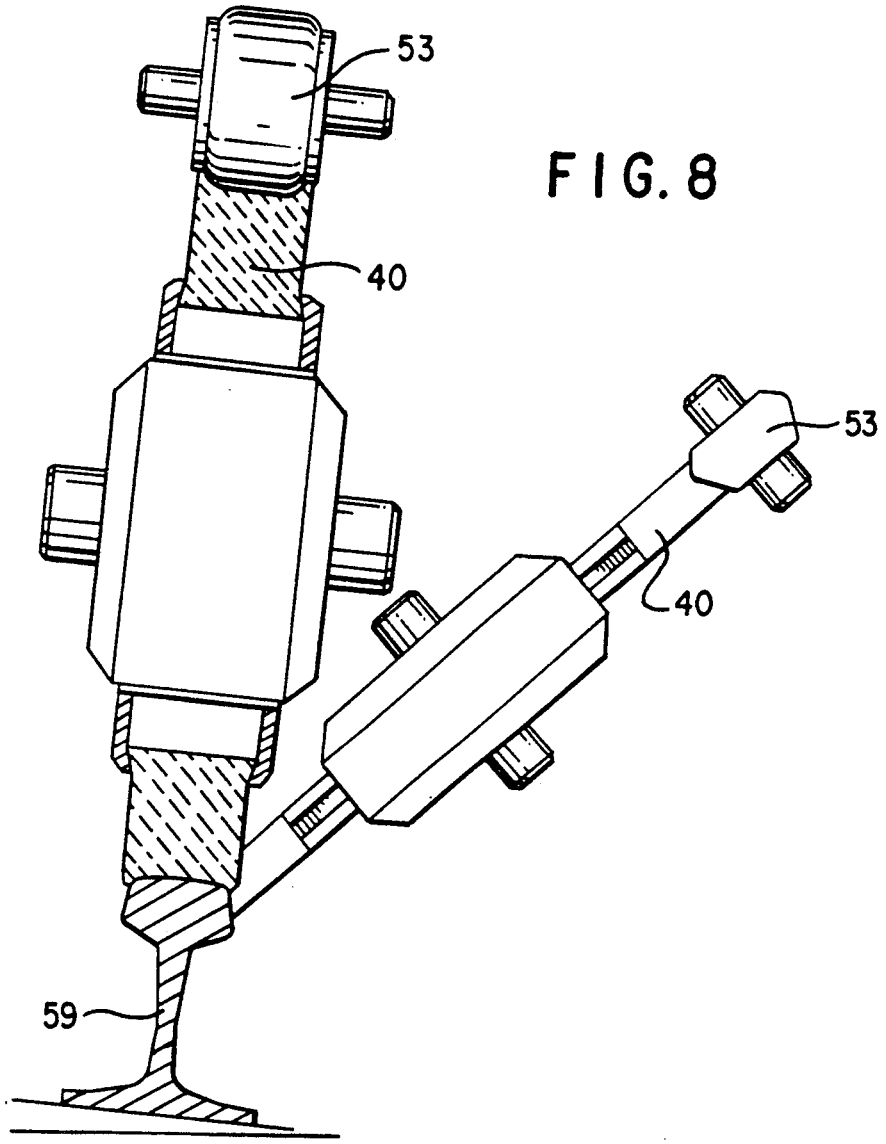
FIG. 8 is a diagrammatic detailed view of two variously inclined grinding devices operating on the same rail.
Figure 9:
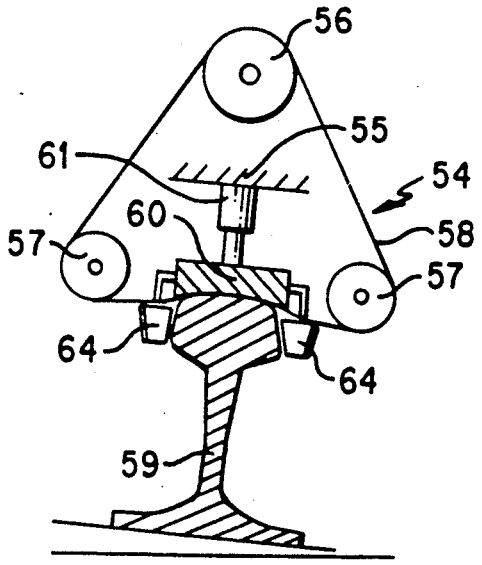
FIG. 9 is a diagrammatic detailed front view of the finishing unit.
Figure 10:
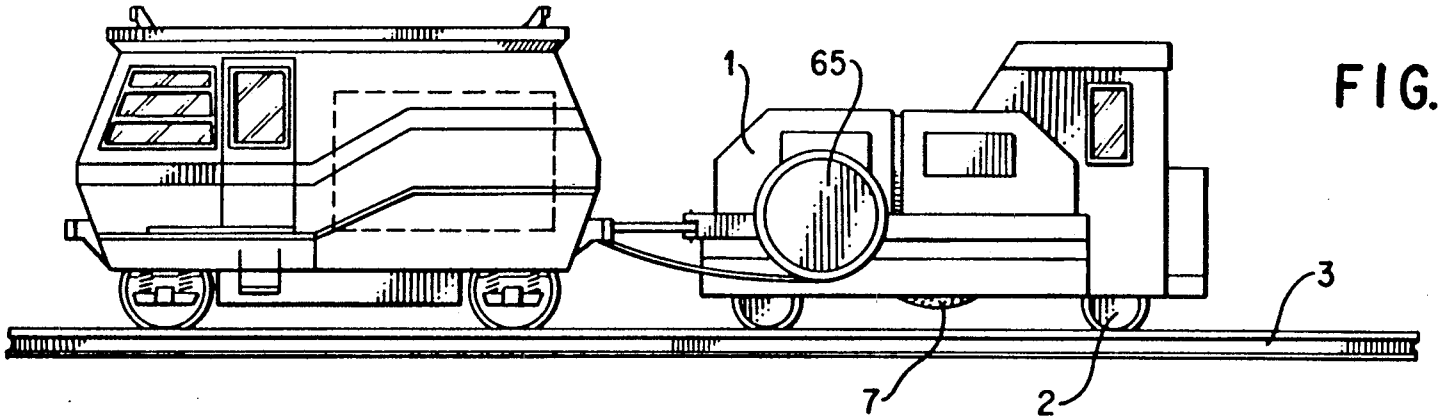
FIG. 10 is a diagrammatic side view of the machine according to the invention coupled to a conveying locomotive.
Figure 11:
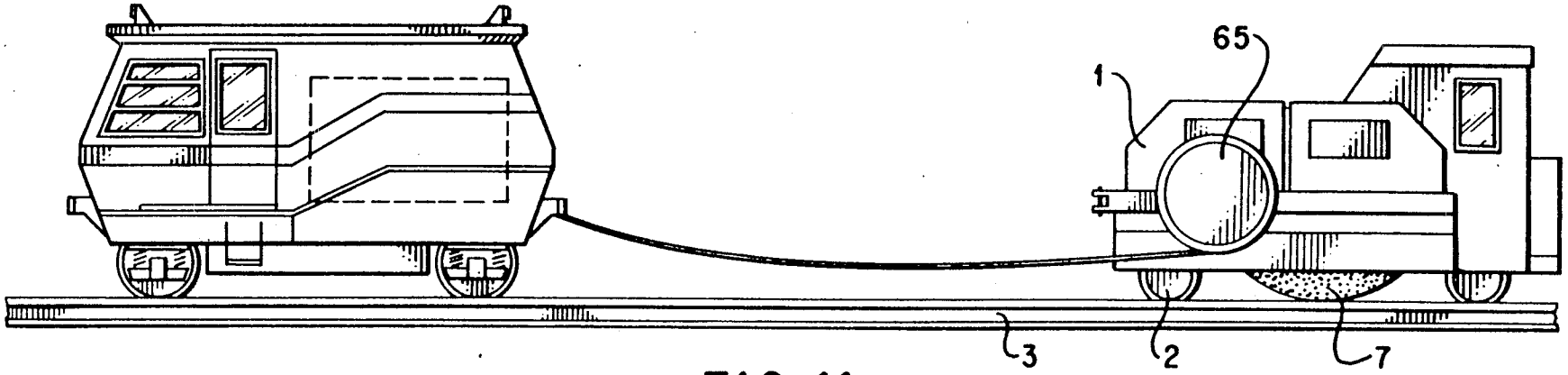
FIG. 11 shows the machine in the same view as FIG. 10 during operation.

In this respect, besides undergoing longitudinal deformation (waviness) determined by its construction, its laying and its use, a rail also undergoes transverse deformation, shown in FIG. 4, in which the continuous line indicates the original transverse profile of the rail and the dashed line indicates its deformed profile (exaggerated). In this case although the grinding action on the one hand leads to the abrasion of the rail, on the other hand it results in non-uniform wear of the abrasive sectors 40, with the result that after a certain time, the transverse profile would remain at least partially deformed even after grinding.

In order to automatically resolve this problem, the profiling roller 53 is provided. For this puprose, it is mounted in a position diametrically opposite the position of contact between the abrasive sectors 40 and the rail 59 and is constructed of diamond-clad material, ie of a material much harder than the constituent material of the abrasive elements, its profile corresponding to that of rail 59. Consequently, if the transverse deformation of the section to be ground leads to non-uniform wear of the abrasive sectors 40 of the grinding wheel, the most worn portions uncover the sensors 50, which cause said sectors to move outwards and interfere with the profiling roller 53, so that their original profile is restored. It is therefore apparent that the profiling roller 53 is normally inactive, but that each time the sensors 50 sense non-uniform wear of the transverse profile of the abrasive sectors 40 they cause it to automatically intervene during the operation of the grinding wheel to an extent just sufficient to restore their original profile.

The inevitable gauge differences which during operation arise between the rail 59 to be ground and the advancing machine are overcome on the one hand by the lateral guide rollers 18 against which the support saddle 11 for the grinding device 7 is thrust by the pneumatic cylinder-piston unit 19, and on the other hand by the axial play between the saddle 11 and the pins 12 and 14 on which it is hinged to the upper frame 10 of the mobile structure 6.

If it is required to operate simultaneously on two rails, the invention provides either for the use of two machines advancing at equal speed, or for the use of a single machine in which two mobile structures 6 are mounted.

If for particular operations the profile of the rail 59 to be ground either cannot be or cannot conveniently be ground by a set of abrasive sectors mounted on a single casing 20 (because the accentuated deformation of the profile would lead to considerable non-uniform wear of the abrasive sectors 40, the invention also provides for mounting on a single machine, and possibly on the same mobile structure 6, two separate grinding devices, one acting mainly in an inclined plane to remove most of the asymmetric deformation of the rail 59, and the other acting subsequently in a vertical plane to restore the original profile.

From the aforegoing it is apparent that the grinding device according to the invention has important advantages by virtue of the new and original operating principle on which it is based, and in particular:

- the circumferential grinding surface is maintained at substantially constant diameter, making it possible to keep the peripheral speed of the abrasive sectors 40 at their ideal value without having in any way to vary their angular speed and without having to vary the position of their axis of rotation as they become worn,
- the abrasive sectors 40 are almost completely utilised, with considerable reduction in machining costs,
- the transverse profile of the abrasive sectors 40 can be automatically restored without interrupting machining, and in all cases limiting the quantity of abrasive material to be removed from said abrasive sectors to that strictly necessary for such restoration,
- any risk of "explosion" of the grinding wheel is obviated, without any limit to its dimensions, by virtue of its separate-part construction,
- improved grinding made possible by the grinding wheel construction in the form of sectors 40, which inter alia ensure better self-cooling,
- improved safety, in that in the case of overloading, the abrasive sector or sectors 40 "yield" inwards, so preventing jamming and damage to the machine under abnormal stress,
- in case of breakage only the abrasive sector or sectors concerned need to be replaced, so reducing the damage which accidental breakage could cause, and the cost of making good the equipment,
- extremely compact construction which considerably reduces overall dimensions compared with those of conventional grinding machines, thus making the rail grinding work easier and quicker,
- grinding can be effected either on one rail or on more than one rail simultaneously, and if only one rail is to be ground only the one machine need be used for the chosen rail,
- very high quality work by virtue of the absence of even minimal faceting of the ground rail,
- the grinding operation, which is itself of high quality, can be followed by a finishing operation which makes the rail particularly suitable to receive sliding contacts,
- grinding can be effected under conditions in which conventional grinding machines cannot operate because of the presence of obstacles such as points, retaining and guide plates at the points or, in the case of tramlines, cement or asphalt, or the counterweb itself,
- sparks are not projected in all directions, because the particular grinding device results in the formation of only a narrow band of sparks substantially limited to the longitudinal direction of the machine, and thus of no importance during working and in any event easily contained,
- during machining, information can be obtained regarding the machining itself and the condition of the workpieces. In this respect, it is clear that for example a regular frequency of signals deriving from the intervention of the sensors 50 distributed along the circumference of the rotary member together with simultaneous issue of signals deriving from the intervention of any sensors disposed in one and the same radial plane indicate correct operation in that the section being machined is substantially rectilinear and not transversely deformed.

The constancy of the outer grinding diameter and of the transverse profile of the abrasive sectors 40 allows an interesting advantageous application of the device according to the invention in checking the longitudinal "planarity" of a ground section.

In this respect, as the grinding machine slides along the actual rails being ground, its operation cannot be influenced by any pre-existing waviness. In other words, as the grinding machine rests the initial undulated longitudinal section into a rectilinear longitudinal section. The greater or lesser approximation of the new undulated section to a rectilinear section depends on many factors such as the extent of the initial deformation, the number, type and distance apart of the point at which the grinding machine rests on the rails, the number of passes etc..

By virtue of the substantially constant grinding circumference, the invention allows ingenious application in estimating the degree of longitudinal planarity of a ground rail. For this purpose, the machine is "calibrated" on a test bench in the form of a piece of perfectly straight rail of known length. A grinding machine provided with a grinding device according to the invention is made to operate on this length of rail, causing the sensors 50 to intervene a number of times depending on the length of the piece, the thickness of the material to be ground, the speed of advancement etc.. This numerical value, which corresponds to the number of interventions of the sensors 50 when the device operates on rails under a condition of perfect planarity, can be associated with the grinding device when operating under these conditions and constitues a lower limiting value towards which a grinding device tends as it approaches these ideal conditions. In practice, by comparing the number of interventions of a machine operating on the deformed rail after correcting to the length of the test bench, with the number of interventions corresponding to the calibrated value, an objective indication is obtained of the extent to which the ground rail differs from conditions of perfect planarity.

I claim:

1. A tangential grinding machine provided with at least one grinding device (7) comprising a rotary member (20), a plurality of abrasive sectors (40) mounted on supports (30.33) radially mobile on said rotary member (20), and members (23,27) for radially shifting said supports (30,33) in order to cause said abrasive sectors (40) to move outwards by an amount suitable for compensating their wear characterised by comprising a plurality of sensors (50) which are activated when a predetermined degree of wear of the abrasive sectors (40) is reached and which act on the radially shifting members (23,27) and further comprising an electronic apparatus (52) which processes the signals originating from the sensors (50) and controls members (46) for radially shifting the supports (30,33) for the abrasive sectors (40).

2. A machine as claimed in claim 1, characterized by comprising, for said grinding device (7), a support member (11) which is disposed on a framework (1) provided with wheels (2), said support members (11) being supported by a frame (10) which can be adjusted in height relative to the framework (1) and rests on a roller assembly (8) which rests on the profile (59) to be ground.

3. A machine as claimed in claim 2, characterised in that the roller assembly (8) consists of a pair of longitudinal bars (15) supporting a plurality of rollers (16) of horizontal axis which are located in the outer regions of said bars (15) to define a free central region for passage of the rotary member (20) with the abrasive sectors (40) of the grinding device (7).

4. A machine as claimed in claim 2, characterised in that the grinding device (7) can be adjusted in height relative to the roller assembly (8).

5. A machine as claimed in claim 1, characterized by comprising a framework (1) provided with wheels (2), a frame (10) adjustable vertically relative to the framework (1) and resting in an articulated manner on a roller assembly (8), and a support member (11) for the grinding device (7), this member being adjustable vertically relative to the frame (10).

6. A machine as claimed in claim 2, characterised in that the position of the frame (10) relative to the framework (1) can be adjusted transversely.

7. A machine as claimed in claim 2, characterised in that the grinding device support member (11) is provided with rollers (18) of vertical axis, which adhere laterally to the profile (59) to be ground.

8. A machine as claimed in claim 7, characterised in that the support member (11) for the grinding device (7) is mobile transversely to the framework (1) and its guide rollers (18) are kept elastically adhering to a lateral surface of the profile (59) to be ground.

9. A machine as claimed in claim 2, characterised in that there is fitted to the framework (1) a finishing unit (54) consisting of, disposed in a transverse plane, an endless abrasive band (58) which is rotated and is arranged such that a portion thereof adheres to the profile (59) which has just been ground.

10. A machine as claimed in claim 9, characterised in that the finishing unit (54) comprises a plate (60) shaped to conform to the profile (59) to be ground and kept forcibly adhering to said profile so as to press the interposed abrasive band (58) against it.

11. A machine as claimed in claim 9, characterised in that the position of the finishing unit (54) can be adjusted transversely relative to the framework (1).

12. A machine as claimed in claim 6, characterised by comprising several grinding devices rotating on one and the same structure (6) the position of which can be adjusted transversely relative to the framework (1).

13. A machine as claimed in claim 2, characterized in that the axis of the rotary member (2) can be inclined to the plane in which the framework (1) rests.

14. A machine as claimed in claim 1, characterised in that the rotary member (20) consists of a cylindrical casing comprising, in a base (24), a plurality of radial slide guides (27') for the mobile supports (27,33) of the abrasive sectors (40).

15. A machine as claimed in claim 1, characterised by comprising a disc (23) mounted coaxially on said rotary member (20) and containing at least one spiral groove (25) of constant pitch engageable by teeth (26) provided in the mobile supports (27, 33), with said disc (23) there being associated means (41,45,46) to cause it to rotate relative to said rotary member (20).

16. A machine as claimed in claim 15, characterised in that the rotary member (20) consists of a hollow cylindrical casing internally housing the disc (23), of which that surface containing the spiral groove (25) faces the circular end wall (24) of said casing, in which the radial guides (27') are provided.

17. A machine as claimed in claim 15, characterized in that the disc (23) comprises an external ring gear with which there engages at least one gearwheel (41) operating under the control of the sensors (50).

18. A machine as claimed in claim 17, characterised in that a plurality of gearwheels (41) are engaged with the ring gear of the disc (23) and are connected by freewheel devices (44) to levers (45) operated with reciprocating motion under the control of the sensors (50).

19. A machine as claimed in claim 18, characterised in that with each lever (45) there is associated a hydraulic cylinder-piston (46) fed through a solenoid valve controlled by the sensors (50).

20. A machine as claimed in claim 1, characterised in that the sensors (50) are of contact type and are positioned in correspondence with the ideal grinding surface.

21. A machine as claimed in claim 20, characterised in that the sensors (50) are disposed in different planes orthogonal to the axis of rotation of the rotary member (20).

22. A machine as claimed in claim 1, characterised in that each abrasive sector (40) is mounted on the relative mobile support (33) with radial play.

23. A machine as claimed in claim 22, characterised in that the connection between each clamp (30) for locking the relative abrasive sector (40) and the support (33) for said clamp (30) is in the form of a pair of connecting bars (36) articulatedly coupled to both to for a parallelogram.

24. A machine as claimed in claim 23, characterised in that the articulation between each connecting bar (36) and the clamp (30) and/or support (33) for the clamp (30) is obtained by a mutually engaging pin (35) and slotted bore.

25. A machine as claimed in claim 14, characterised in that each mobile support comprises a slide (27,33) mobile radially along the rotary member (20), and a clamp (30) fixed to said slide (27) and provided with removable locking jaws for the abrasive sector (40).

26. A machine as claimed in claim 1, characterised by comprising a profiling roller (53) constructed of diamond-clad material, and having a transverse profile identical to the transverse profile of the workpiece (59) to be ground, said profiling roller (53) being located on the ideal grinding surface in a position separate from the position of contact between the abrasive sectors (40) and the profile (59) to be ground.

* * * * *